United States Patent [19]

Betts et al.

[11] Patent Number: 4,526,019

[45] Date of Patent: Jul. 2, 1985

[54] YARN FEED MECHANISM

[75] Inventors: Max W. Betts, Falmouth, England; Nigel Johnson, deceased, late of Ripley, England; by Ernest W. Bennett and Joyce H. Bennett, executors, both of Belper, England

[73] Assignee: Courtaulds Plc, Derbyshire, England

[21] Appl. No.: 530,347

[22] Filed: Sep. 8, 1983

[30] Foreign Application Priority Data

Sep. 14, 1982 [GB] United Kingdom ..... 8226117

[51] Int. Cl.[3] ..... D04B 15/48

[52] U.S. Cl. ..... 66/132 R; 66/146

[58] Field of Search ..... 66/146, 132, 125, 158, 66/161; 242/149; 226/195, 118

[56] References Cited

U.S. PATENT DOCUMENTS

| | | | |
|---|---|---|---|
| 2,023,515 | 12/1935 | Chatfield | 66/132 |
| 2,108,773 | 2/1938 | Lawson | 66/146 |
| 3,093,306 | 6/1963 | Schmidt | 66/132 X |
| 3,912,184 | 10/1975 | Bous | 66/132 X |
| 4,250,722 | 2/1981 | Betts et al. | 66/146 |
| 4,271,687 | 6/1981 | Memminger et al. | 66/146 |

FOREIGN PATENT DOCUMENTS

| | | |
|---|---|---|
| 442267 | 8/1935 | United Kingdom . |
| 840618 | 10/1958 | United Kingdom . |
| 1434021 | 6/1972 | United Kingdom . |
| 1409581 | 6/1973 | United Kingdom . |
| 1481995 | 9/1974 | United Kingdom . |
| 1494366 | 3/1975 | United Kingdom . |
| 2023670A | 6/1979 | United Kingdom . |

*Primary Examiner*—Ronald Feldbaum

*Attorney, Agent, or Firm*—Howson and Howson

[57] ABSTRACT

A yarn feed mechanism for a knitting machine incorporates a power operated yarn feed device, for example motor-driven rollers, a yarn take-up device, for example one or more pivotally mounted yarn take-up yarns, and a yarn restraining device, for example one or more yarn tensioning devices. The yarn feed mechanism is arranged so that yarn to be knitted follows a path from the yarn feed device through the yarn restraining device to the yarn take-up device and then to needles of the knitting machine.

6 Claims, 4 Drawing Figures

YARN FEED MECHANISM

Figure 1:
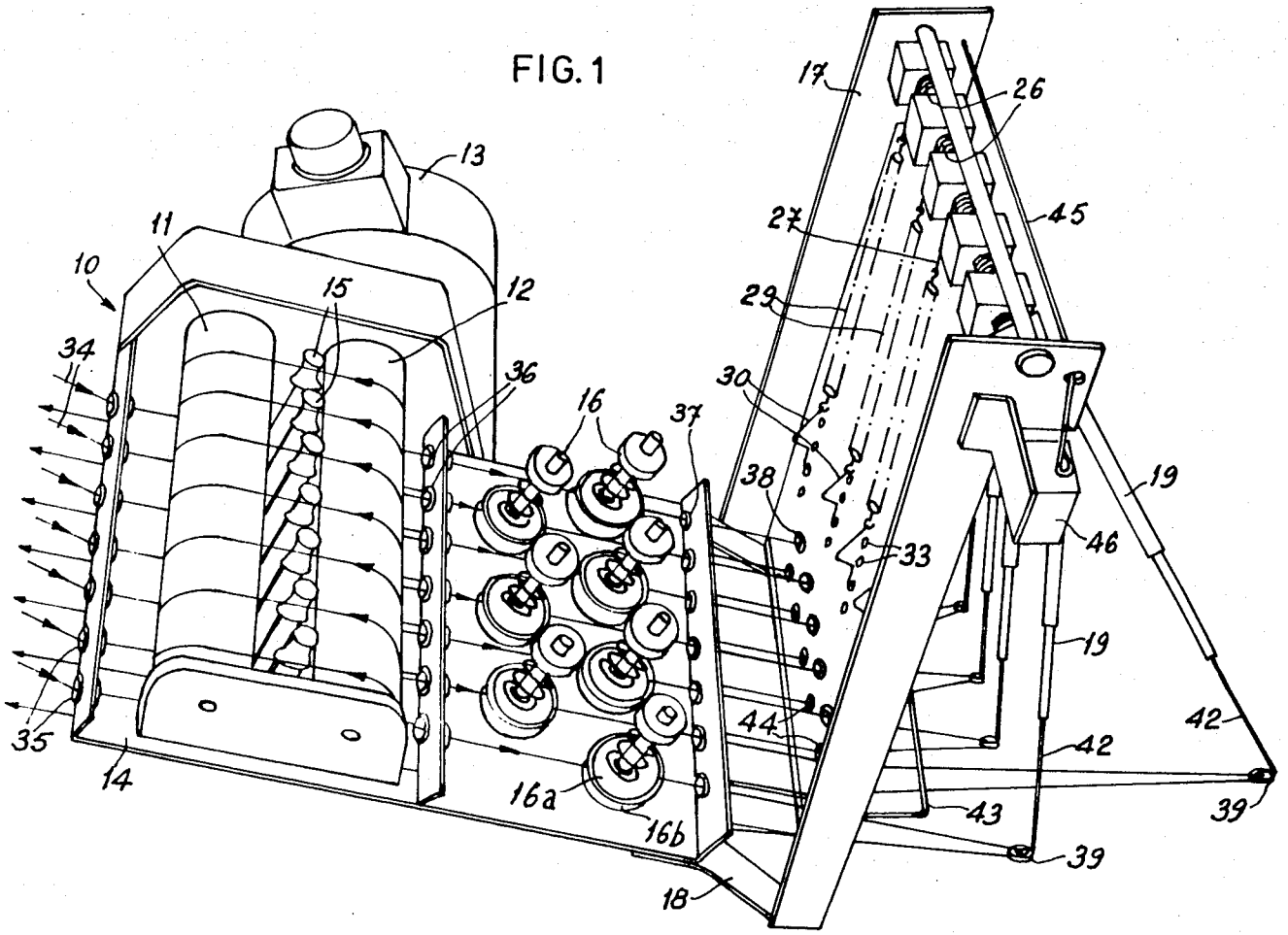

This invention relates to a yarn feed mechanism for a knitting machine.

In many circumstances it is desirable that yarn should be fed to a knitting machine under a substantially constant low tension but with the facility to take up relatively long lengths of yarn quickly when occasion demands. Such circumstances may occur, for example, in flat V-bed knitting machines when knitting shaped pieces of fabric which have parts differing substantially in knitting width.

One solution adopted to overcome the problem of supplying the yarn in such a way as to fulfil these criteria has been to use a mechanism which comprises a yarn feed device together with an air take-up device in which a loop of yarn is subjected to the action of a jet of air so that when yarn is to be taken up quickly the air jet will quickly increase the length of the yarn loop. Such a device is expensive in its consumption of compressed air and has been found not always to provide such positive control of the yarn as is deemed desirable.

The present inventon is intended to provide a yarn feed mechanism which fulfils the yarn feed criteria set out above but which provides more positive control of the yarn and which can incorporate a mechanical yarn take-up device instead of the air jet yarn take-up device of this known yarn take-up mechanism. The positive control is provided by the use in the yarn feed mechanism of yarn restraining means and it has been found, surprisingly, that such yarn restraining means can be incorporated in the yarn feed mechanism without increasing deleteriously the tension in the yarn fed by the device but, on the contrary, that the incorporation of yarn retaining means enhances overall the performance of the yarn feed mechanism.

According to the invention, a yarn feed mechanism for a knitting machine comprises a power operated yarn feed device, a yarn restraining device and a yarn take-up device arranged for yarn to follow a path from the feed device through the yarn restraining device to the yarn take-up device and thence to needles of the knitting machine.

The yarn restraining device may be constituted by a yarn tensioning device.

Preferably, the feed device is arranged to feed yarn at a speed approximately equal to twice the maximum speed at which yarn will be taken up by the needles when the yarn is being knitted, the feed device being arranged to feed only when tension is applied to the yarn leaving the feed device.

The yarn take-up arm may be mounted adjacent other yarn take-up arms on a common base in association with a yarn feed device arranged to supply yarn to all the yarn take-up arms.

A common stop motion may be arranged to be operated by any one of the yarn take-up arms should that arm rotate on its pivot beyond a position designed as its normal operating limit for yarn take up. Preferably each yarn take up arm has a substantially stiff major portion and a flexible end portion carrying a yarn guide and the common stop motion comprises a common trip member located in the rotational path of the yarn take-up arms and arranged to operate a stop motion switch.

Figure 2:
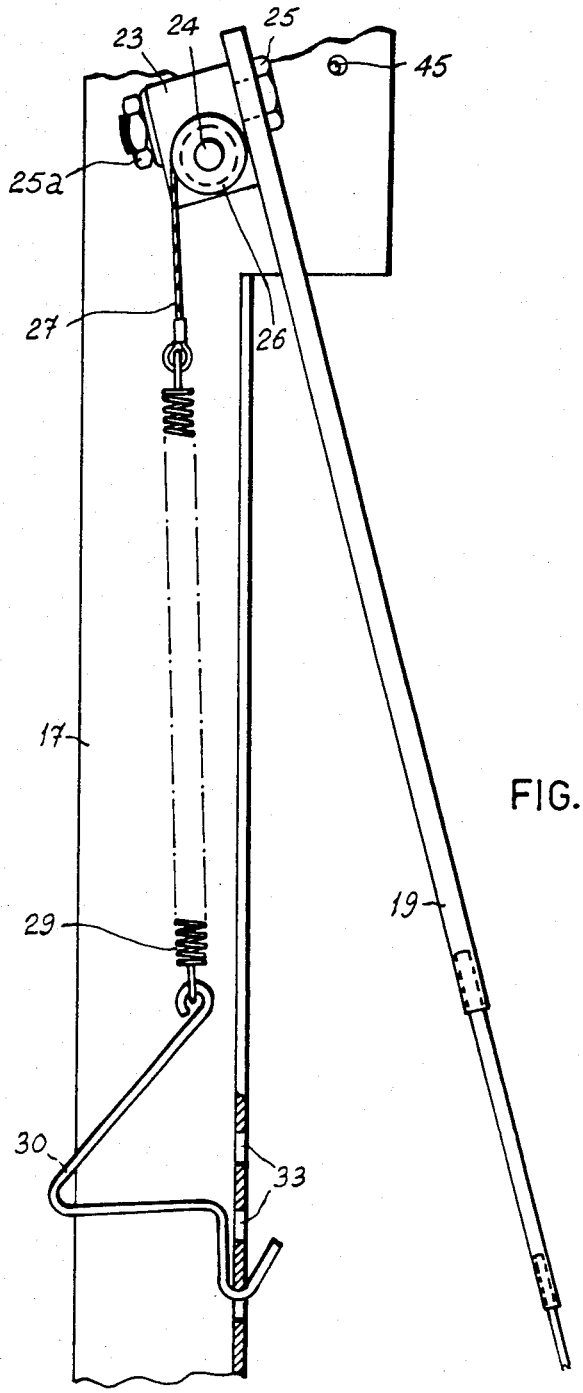
Figure 3:
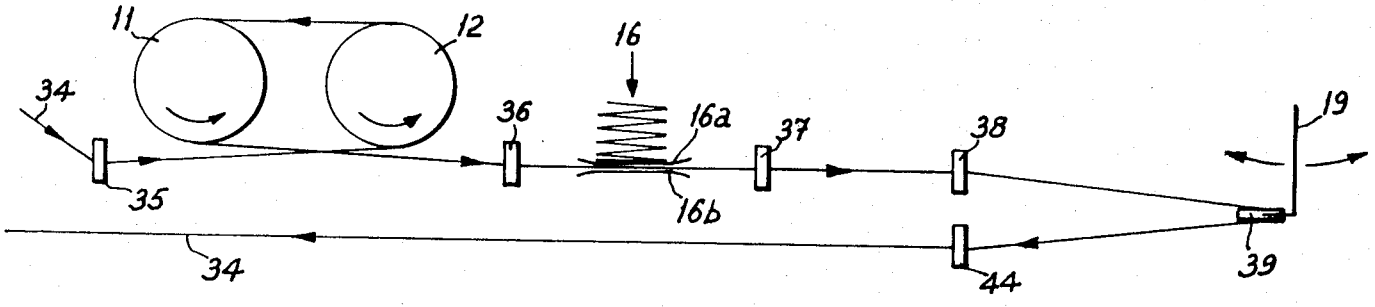
Figure 4:
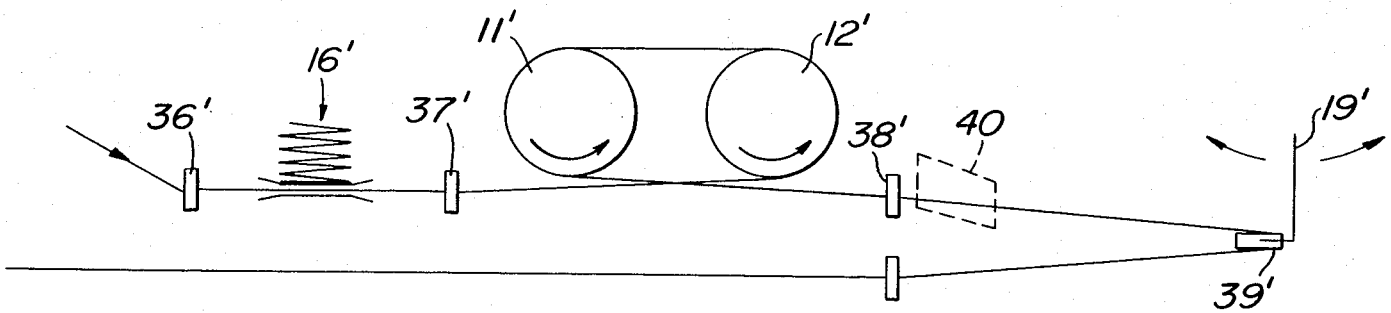

The invention will be further described, by way of example, with reference to the accompanying drawings in which:

FIG. 1 is a perspective view of a feed mechanism according to the invention, FIG. 2 is a schematic enlarged sectional side view of one take-up arm and the base on which it is mounted in a feed mechanism similar to that shown in FIG. 1, FIG. 3 is a schematic view showing one yarn path through the mechanism of FIG. 1, and FIG. 4 is a schematic view showing one yarn path through an alternative mechanism in accodance with the invention.

The yarn feed mechanism according to the invention shown in the drawings comprises a power operated feed device 10 having two rollers 11 and 12 driven by an electric motor 13. The rollers 11 and 12 are mounted parallel to but spaced from one another on a base 14 and located between them is a row of studs 15 serving to guide yarns threaded round the rollers as will be described below.

Also mounted on the base 14 is a set of yarn restraining devices constituted by tensioning devices 16 arranged in two rows in a staggered configuration. Each yarn tensioning device 16 is of conventional construction in which an upper disc **16*a* is spring loaded onto a lower disc 16*b*** and yarn passes between the two discs.

Mounted on a frame 17 rigidly connected to the base 14 by brackets 18 is a set of yarn take-up arms 19, in the present case seven take-up arms. The mounting of the yarn take-up arms 19 can be effected in various ways, and one such way is illustrated in FIG. 2 which shows one take-up arm 19 carried by a block 23 pivoted on a shaft 24 carried by the frame 17. The take-up arm 19 is secured to the block 23 by means of an apertured pin 25 having a screw-threaded end carrying a nut **25*a* which can be tightened to pull the take-up arm 19, which is engaged in the aperture in the pin 25, against the block 23**.

Rigid with the block 23 is a cylindrical boss 26 around which is wound a multi-strand wire 27 secured to the boss 26. The end of the wire 27 remote from the boss 26 is attached to a coil spring 29 connected to a hook 30 which can be engaged in one of a number of holes 33 in the frame 17. The spring 29 exerts a force on the take-up arm 19 through the boss 26 and block 23 urging the take-up arm 19 to rotate in an anti-clockwise direction as shown in FIGS. 1 and 2. The magnitude of the force exerted on each take-up arm 19 in this way can be adjusted by choice of the hole 33 in which the respective hook 30 is engaged.

In threading the device shown in the drawings, yarn 34 is lead from a package (not shown) through one of a set of yarn guides 35 underneath and clear of the roller 11, to one side of one of the studs 15, around the roller 12 and back around the roller 11 in order to obtain an angle of wrap of the yarn about the rollers 11 and 12 equal to at least 360°. In some cases, for example when knitting especially highly frictional yarns, that is yarns with a high coefficient of friction, for example 0.2, with respect to the surface of the rollers 11 and 12 (and thus with respect to the preceding yarn guides, which are not shown in the drawings), the yarn may be wrapped twice round the rollers 11 and 12 so as to traverse the path around the rollers shown in FIG. 3 twice over. A single wrap of yarn (360° contact) about the rollers 11 and 12 would be expected to give a reduction in tension, comparing yarn approaching the rollers through guides 34 with yarn leaving the rollers through guides 36, of approximately 10:1. Often this reduction will produce an acceptable tension in the yarn supplied to the needles of the knitting machine, but in the case of highly frictional yarns resulting in a high yarn tension at the guides 34, a reduction of 20:1 obtained by a double wrap (720° contact) may be desirable.

From the roller 11, the yarn is lead underneath and clear of the roller 12, through one of a set of yarn guides 36 and between the discs 16*a* and 16*b* one of the yarn tensioning devices 16. The yarn is then lead through one of a set of yarn guides 37 and through one of a set of yarn guides 38 mounted on the frame 17 to an eyelet 39 carried on the end of one of the take-up arms 19.

Alternatively, as shown in FIG. 4, the yarn tensioning devices 16' may be located before the rollers 11' and 12' along the path of the yarn. Each yarn end is then threaded through a separate conventional yarn trap 40 serving as a yarn restraining device between the guide 38' and the associated yarn take-up arm 19'. Each pair of guides 36' and 37' are then located with the associated yarn tensioning device 16 before the rollers 11' and 12'. The yarn traps are necessary in such a case in order to restrain the yarn and prevent it from being taken from the feed rollers 11' and 12' by the corresponding yarn take-up arm 19' which would rotate to carry its eyelet 39' outwards to the limit of movement of the yarn take-up arm.

For example, if the rollers 11' and 12' are arranged to deliver yarn when yarn is pulled from them under a tension of 1 g and each yarn take-up arm is spring loaded to exert up to 10 g tension on the yarn, it is clear that such movement of the yarn take-up arm will occur.

Returning to FIG. 1, eyelet 39 is carried on the end of each take-up arm 19 remote from the shaft 24. An end portion 42 of each take-up arm 19 is of resilient wire but the remainder of each take-up arm is made from lengths of stiff tubing, the diameters of the lengths increasing in size towards the shaft 24. This construction achieves rapid rotational movement of each take-up arm around the shaft 24 under the influence of the associated spring 29 when the take-up arm is released from any constraining force. The resilient wire end portion 42 of each take-up arm will take up rapid changes in the force exerted on the take-up arm by the yarn without causing substantial movement of the arm. This assists in maintaining yarn tension substantially constant.

A guide wire 43 mounted on the frame 17 limits the movement of the free ends of the take-up arms 19 towards the frame 17, the closest distance of approach of each eyelet 39 to the frame in the unflexed state of the end portion 42 being, in the present case, 25 mm.

From an eyelet 39, the yarn is lead through one of a set of guides 44 mounted on the frame 17. Each guide 44 is associated with a corresponding eyelet 39 and is substantially level with that eyelet when the arm 19 is close to the guard wire 43 so that a straight length of yarn passes from an eyelet 39 through the associated guide 44 without any substantial frictional contact with the guide 44 and away from the yarn feed mechanism.

A stop unit is mounted on the frame 17 and comprises a trip wire 45 extending across the frame 17 near and parallel to the shaft 24 on the side of the take-up arms 19 and remote from the frame 17. The trip wire 45 is moved by any take-up arm 19 which is allowed to rotate without constraint and operate a stop switch 46 to which it is connected.

In a flat V-bed knitting machine, the present yarn feed mechanism may be mounted at one end of the needle beds and will then receive yarn from yarn packages mounted above the needle beds and will supply yarn through the guides 44 along the needle beds to the needles.

Preferably, the rollers 11 and 12 are rotated at a rate such that their peripheral speed is approximately equal to twice the maximum speed at which yarn is intended to be supplied to the knitting machine by the mechanism. Therefore, in the case of a yarn feed mechanism for a flat V-bed knitting machine, the rollers preferably have a peripheral speed of approximately 5 m/s. The diameter of the rollers 11 and 12 may be in the range from approximately 2.5 cm to 5 cm or perhaps 6 cm and preferably at the upper end of that range. Such dimensions result in a yarn feed mechanism of reasonably small size giving satisfactory reductions in yarn tension. However, the length of surface contact of the yarn with the rollers 11 and 12 has been found to be significant in reducing tension in the yarn fed to the needles and this length of contact can be increased by increasing the diameter of the rollers 11 and 12 or wrapping the yarn more than once round those rollers.

The bosses 26 may have a diameter of 2 cm. This diameter is kept as low as possible to ensure that sufficient movement of the take-up arms 19 is obtained with the lowest possible change in the length of the springs 29 and thus without significant falling off of the force exterted by the springs 29.

The input tension of the yarn supplied to the yarn feed mechanism is arranged to be as low as possible and the yarn tensioning devices 16 are set to introduce as low a tension as possible to restrain the take-up arms 19 and prevent them moving away from the frame 17.

The feed device 10 feeds each yarn on demand when the needles of the knitting machine draw yarn from the feed mechanism and thus tighten the yarn round the rollers 11 and 12. When a particular yarn is not drawn off by the knitting machine, the yarn is loosened about the rollers 11 and 12 which continue to rotate without feeding it.

Instead of using in a yarn feed mechanism according to the invention, one or more yarn take-up arms 19, another, known, mechanical yarn take-up device may be used or even an air jet device to take up yarn, although a mechanical yarn take-up device is preferred.

What is claimed is:

1. A yarn feed mechanism for a knitting machine, comprising:

(a) power operated yarn feed means for feeding yarn at a speed greater than the maximum speed at which yarn is taken up by the needles of the knitting machine, and control-responsive to tension in the yarn leaving said yarn feed means, (b) yarn take-up means for rapid take-up of excess yarn, and (c) yarn restraining means arranged on a yarn path between said feed means and said yarn take-up means for restraining removal of yarn from said feed means by sole action of the yarn take-up means.

2. A yarn feed mechanism as claimed in claim 1, wherein said yarn take-up means is constituted by a pivotally mounted yarn take-up arm.

3. A yarn feed mechanism as claimed in claim 2, wherein said yarn restraining means is constituted by a yarn tensioning device.

4. A yarn feed mechanism as claimed in claim 2, wherein said yarn restraining means is constituted by a yarn trap.

5. A yarn feed mechanism as claimed in claim 2, including a plurality of yarn take-up arms, said take-up arms being mounted adjacent one another on a common base, and wherein said yarn feed means is arranged to supply yarn to all the yarn take-up arms.

6. A yarn feed mechanism as claimed in claim 2, in combination with a knitting machine, wherein said yarn feed means feeds yarn at a speed approximately equal to twice the maximum speed at which yarn is taken up by the needles of the knitting machine.

* * * * *